United States Patent [19]

Lindström

[11] 4,210,077

[45] Jul. 1, 1980

[54] PRINTING MACHINE

[75] Inventor: Nils A. E. Lindström, Ruml/o/ Rönninge, Sweden

[73] Assignee: Svecia Silkcreen Maskiner AB, Sweden

[21] Appl. No.: 870,587

[22] Filed: Jan. 18, 1978

[51] Int. Cl.[2] ..... B05C 17/08

[52] U.S. Cl. ..... 101/126; 101/123; 271/241

[58] Field of Search ..... 101/123, 118, 124, 55–56, 101/407 BP, 126, 269, 250, 251; 271/232, 241; 269/304, 305, 309, 320

[56] References Cited

U.S. PATENT DOCUMENTS

| | | | |
|---|---|---|---|
| 3,857,337 | 12/1974 | Tsuji | 101/126 |
| 4,040,352 | 8/1977 | Curti | 101/126 |
| 4,058,307 | 11/1977 | Bubley | 101/123 |

*Primary Examiner*—Paul T. Sewell
*Assistant Examiner*—A. Heinz
*Attorney, Agent, or Firm*—Burns, Doane, Swecker & Mathis

[57] ABSTRACT

A printing machine having a reciprocatingly movable printing table, preferably of the type having a stencil and a squeegee associated therewith is disclosed. Said squeegee being intended, in a printing position for the material, to press printing ink through the stencil to a rigid material arranged beneath the stencil. Said printing table is movable between a first position, i.e. a material insertion position, and a second position, i.e. a material printing position, and said printing table exhibiting one or more fixed registering means arranged to co-act with corresponding registering means in said material to position said material relative to said printing table in the material insertion position of said table, subsequent to the material occupying the printing position and print being applied to said material. The registering means are activated between the printing table and devices releasing said material. Said releasing devices being arranged to lift the leading edge of the material upon movement of the table towards the first position, the material insertion position, and permitting said edge to strike a stopping device arranged to stop movement of the material with the table and extending across the table. Said stopping device causing the material to be brought into co-acting engagement with a discharge or conveying means.

12 Claims, 13 Drawing Figures

PRINTING MACHINE

BACKGROUND OF THE INVENTION

The present invention relates to a printing machine, and more particularly, to the type of printing machine which is provided with a reciprocatingly movable printing table. The printing table is arranged to move from a position in which material to be printed is placed upon the table (hereinafter referred to as the material-insertion position) to a position in which material is printed (hereinafter referred to as the printing position) and back again.

Although the present invention can be applied to any type of printing machine operating in accordance with the above, the following description will be made with reference to a silkscreen printing machine. Such a printing machine has a stencil mounted above the printing table, and a squeegee which is associated with the stencil and which rests against the same during a printing operation, the squeegee being arranged, in the material printing position, to move across the stencil and to press printing ink therethrough to a rigid material carried by the printing table beneath the stencil.

By rigid material is meant here, and in the following, a material which can be lifted by its edge from the printing table and/or a material whose edge can abut a stop during movement of the printing table while permitting an opposite edge of the material to be displaced along the printing table during said movement without the material wrinkling. Such rigid material may comprise such card or board as that is provided by the printing machine during a printing operation with a printed circuit diagram or an insulating layer.

As before mentioned, the printing table shall be able to move between a first position, i.e. a material-insertion position, and a second position, i.e. a printing position. To enable the material to be localised or registered in relation to the printing table and the stencil, together with its pattern, placed above said table, there is provided on the printing table registering means with which the material, and particularly corresponding registering means formed in the material, shall be brought to co-act. In order to obtain exact registry, the registering means (pins) of the printing table and the registering means (holes) of the material shall be caused to co-act with each other. These registering means shall be caused to co-act with one another when the printing table occupies its first position, since when occupying its second position the printing table is located immediately beneath the stencil and other means for printing the material.

Since the orientation of the printing table in its second position is exactly related to the frame and to the pattern on the stencil, registration of the material in the first position relative to the table will be the same as in the second position.

It is known to arrange on the printing table of a printing machine, and particularly, on the printing tables of silkscreen printing machines, fixed peg-like registering means. These registering means shall be caused to co-act with holes disposed in the material to be printed. In this way, the material is positioned exactly relative to the printing table and the patterned stencil arranged thereabove. Such peg-like registering means are primarily used when manufacturing printed circuit cards, although they can, of course, be used for other material to be printed.

When the material is to be printed in limited quantities, it is necessary after a short period of time to change the position of the fixed registering means, in a manner such that their mutual position corresponds to the corresponding registering means in the new material to be printed. This can readily be effected in accordance with the invention, owing to the fact that the registering means are displaceably arranged in grooves but can be secured by means provided therefore in predetermined positions or in any selected position.

It is normal, however, for the groove of the registering means to be open. In such case, however, the pattern will not be transferred to the material with sufficient accuracy, owing to the fact that the material adjacent the groove is bent down by the force exerted thereon by the stencil and the squeegee. Although it has long been desirable to fill the groove between the registering means, those measures hitherto proposed have been much too complicated.

It is also desirable, particularly in the case of printing machines in which only a small number of printing operations is to be carried out, for the actual registering of the registry means, and the registry means, to take place in the first position of the printing table, and for the registry means to be placed in the vicinity of the edge facing the person placing the material onto the table. In this way, the material can be inserted and registered very rapidly and in a manner which can be readily superintended and checked. The material is registered in relation to the printing table by inserting the peg-shaped registering means into holes formed in the material. When the width of the material to be printed allows it, two or more sheets of different material can be placed side by side on the table, and the separate materials provided with different print.

OBJECTS AND SUMMARY OF THE INVENTION

One object of the present invention is to provide a printing machine which fulfils the aforementioned requirements.

The present invention relates to a particular registering means provided with an edge. This edge is intended to be engaged in a lower portion of a groove, while the central portion of the registering means is adapted to pass through a centrally arranged constriction and to protrude slightly into the upper part of the groove. In this way it is possible to arrange for the registering peg associated with the registering means to extend somewhat above the printing surface on the printing table. Since the profile of the registering means has been given such a form, the profile can be inserted into the groove upside down and, in this way, the bottom portion of the profile will, in this reverse position, form part of the planar printing surface. Thus, in this way the profile can contribute to providing a planar printing surface in a simple manner. A plurality of different registering means may be available, possibly of different lengths, and it may be convenient to cover the distance between the registering means used by the profile.

BRIEF DESCRIPTION OF THE DRAWINGS

The invention will be more readily understood and optional features thereof made apparent by reference to the accompanying drawings, in which.

DETAILED DESCRIPTION OF THE INVENTION

Figure 1:
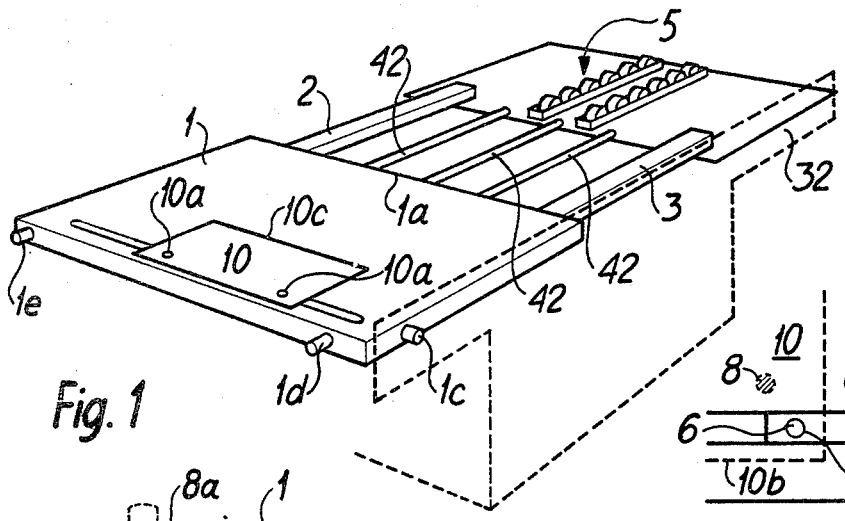
FIG. 1 is a greatly simplified, perspective view of a printing machine according to the present invention having a reciprocatingly movable printing table.

FIG. 1 is a simplified view in perspective of a printing machine having a reciprocatingly movable printing table, said table being arranged for movement from a first position, the material insertion position, to a second position, the material printing position. In FIG. 1, the table is shown in its material-insertion position.

The illustrated printing machine of FIG. 1 is assumed to be a silkscreen printing machine, although parts of the machine essential for its operation have been removed for the sake of clarity.

Placed on the printing table 1 is a sheet of material 10, hereinafter referred to as the material. The printing table comprises an upper surface and a lower, movable frame structure, the upper surface being adjustable relative to the frame structure by means of setting devices 1*c*, 1*d* and 1*e*. The printing table 1 is arranged to be moved reciprocatingly by means of a pneumatic piston-cylinder arrangement, not shown in the figure. The table is arranged to be moved from the first position, illustrated in FIG. 1, to the printing position at a first speed, while movement of said table 1 from the second position, i.e. the printing position, towards the material-insertion position initially takes place at a slower speed but increases as the table approaches the FIG. 1 position. This change in the speed at which the table moves is selected in order to obtain more uniform removal of the printed material from the printer, which removal will be explained in more detail hereinafter. Movement of the lower frame is guided by two parallel guides 2, 3. In the following the invention will be described with reference to a silkscreen printing machine comprising a stencil mounted above the printing table (the stencil not being shown in the Figure) and a squeegee associated with the stencil, the stencil being adapted to press printing ink, in the material printing position, through the stencil to a stiff material positioned beneath said stencil.

Arranged beneath the edge 1*a* of the printing table 1 on the lower frame structure is a plurality of rod-like members 42 which serve as discharge means for the printed material. Although FIG. 1 only shows three such rod-like means, it will be understood that the number of rods can be varied, depending upon the width of the material 10 to be printed. The free ends of the rod-like members 42 lie adjacent a discharge or conveying means 5 comprising wheels or rollers, the nature of which discharge or conveying means will be described in more detail hereinafter.

Since it is necessary to position the material 10 exactly in relation to the printing table 1 and thus also in relation to the frame structure and to the pattern on the stencil, it is necessary to provide the sheet with registering means. In the illustrated embodiment, these registering means have the form of two holes 10*a* arranged in the material, each of the holes being arranged to engage a respective one of two pegs 6 disposed in a groove 7 in the printing table. This groove will be described in more detail with reference to FIGS. 9–13.

Figure 3:
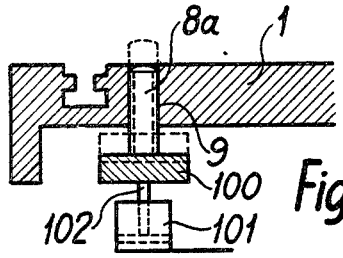
FIG. 3 is a sectional view through the printing table, illustrating a device for releasing a material from the registering means.
Figure 7:
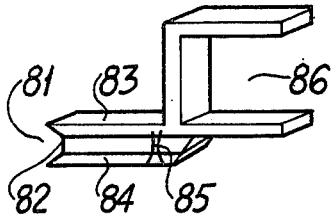
FIG. 7 illustrates the stop means in perspective.
Figure 8:
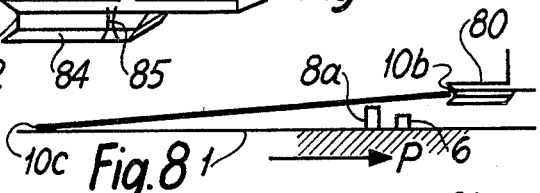
FIG. 8 illustrates a device for releasing the material from the registering means in an activated position, which material is caused to co-act with the stop means shown in FIG. 7 as the result of movement of the table.

Subsequent to printing the material in the printing position, the material is released from the registering means by means provided therefor. These means comprise pins 8*a* which extend in one or more through-passing holes 9 disposed in the printing table 1. The holes extend vertically and are arranged to accommodate respective pins 8*a*, of which pins only one is shown inserted in a hole 9. Each pin 8*a* is arranged to rest against a beam 100 which is guided at the ends thereof in a manner such that while the beam can be moved up and down it cannot be moved laterally. The beam 100 extends across the whole of the table parallel to the edge 1*a* and each pin 8*a* inserted in a respective hole 9 will fall into abutment with the beam 100. The beam 100 can be lifted to the position shown by the dotted lines in FIG. 3 by means of a cylinder 101 and a piston 102, wherewith respective pins 8*a* will also be moved upwardly in respective holes 9 to the position shown in dotted lines. When the pins 8*a* are moved upwardly they will engage an edge of the material and lift the same, to move the holes 10*a* in the sheet 10 out of engagement with the registering pegs 6, thereby to release the material 10. This is best seen from FIG. 8. As the table moves towards the material insertion position (the direction P in FIG. 8), the uplifted edge 10*b* will strike against a device 80 which stops the movement of the material with the table. This device co-acts with the material until the table occupies the position for receiving fresh material, and immediately after the table is caused to move towards the printing position, the device 80 ceases to co-act with the printed sheet and the printed sheet is caused to co-act with the discharge and conveying means 4. This is effected by causing the edge 10*c* to co-act with the rods 42 and immediately the table 1 begins to move towards the printing position, the sheet 10, as a result of friction, will accompany the table and release its engagement with the device 80, the sheet 10, after the printing table has been moved to the printing position, adopting the position shown in FIG. 5.

During this movement of the table 1 towards the printing position, the previously printed material is transferred from the rod-shaped discharge means 42 to a conveyor means 5 comprising wheels or rollers. The upper surface 4a of the rods is located beneath the upper surface 5a of the rollers.

Each roller is removable, and by removing one or more rollers the speed at which the material 10 is conveyed on this part of the conveying means can be regulated so as to be lower when fewer rollers are used. A plurality of rollers co-act with a U-shaped rail 5b which is removably connected to a holder 5d by means of screws 5c. In this way, the rail 5b can be arranged in any side position, although it shall always be parallel with the rods 4.

Each rod 4 is connected, via means 4b to the frame arranged beneath the printing table.

Figure 5:
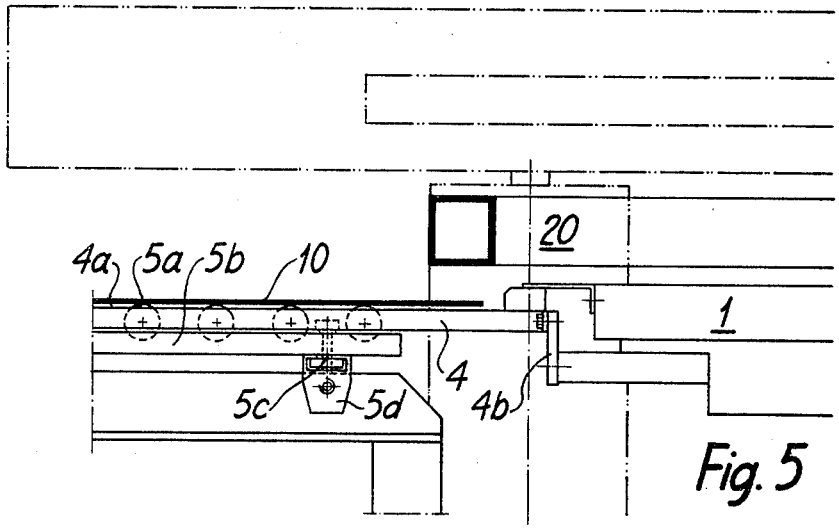
FIG. 5 is a side view of the printing table in the second position, the printing position, with a printed material resting on the roller conveyor.

In FIG. 5 there is illustrated a frame 20 adapted to carry the table, the stencil and means for securing the squeegee and the ink reservoir during their movement across the stencil, and also the frame of the machine.

Thus, the rail 5b is laterally displaceable relative to the rods 4 and the table 1. As previously mentioned, the means for releasing the holes 10a from the registering pegs 6 comprise one or more pins 8a inserted in some or all of the holes 9 formed in the printing table 1. The holes 9 are arranged in a row and are located adjacent the registering means 6, but on the side of said registering means facing the centre of the material 10.

As also before mentioned, all the pins 8a rest at one end thereof against the beam 100 which can be moved up and down by means of the piston-cylinder device 101, 102 to lift the edge 10b of the material.

Figure 4:
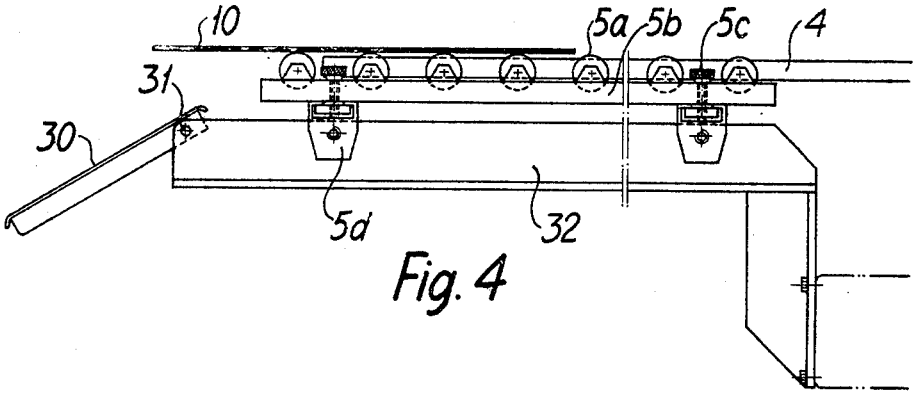
FIG. 4 is a side view of a roller conveyor for discharging the material from the printing machine.

As illustrated in FIG. 4, the roller-conveyor means 5 terminates adjacent an incline surface 30 which is hinged to the frame 32 of the printing machine by means of a hinge 31.

Figure 6:
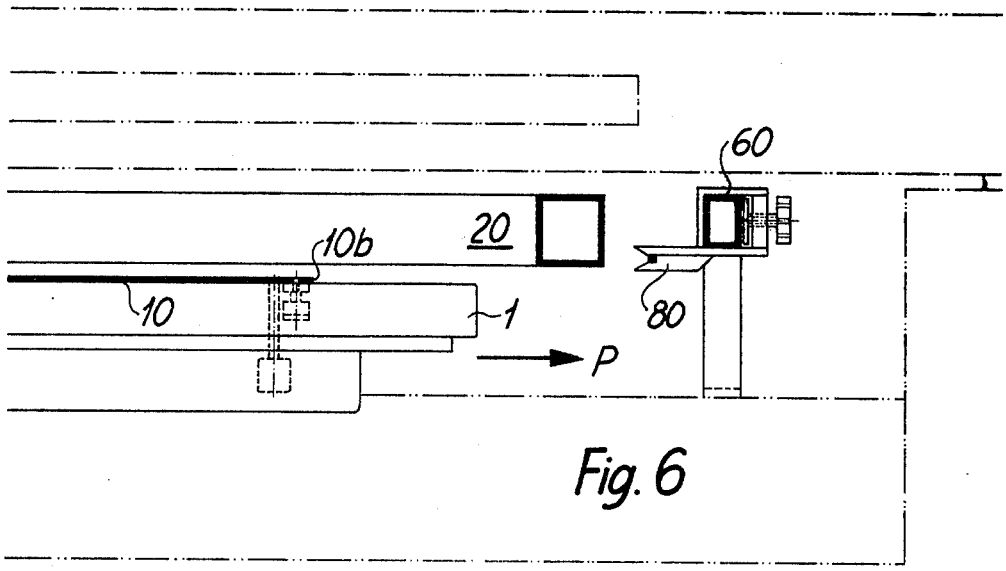
FIG. 6 illustrates the printing table in the printing position with material resting on said table; and means for stopping movement of the material with the table.

FIG. 6 illustrates the device 80 for stopping movement of the material with the table 1, said device 80 comprising one or two fixed supports mounted on a beam 60 which extends across the printing table and which is fixedly mounted to the frame. Conveniently two devices 80 are provided for a sheet of material. When two sheets of material are printed simultaneously, four such stop devices are required. The device 80 may also comprise an elongate unit extending along the beam 60.

As soon as print has been applied to the material 10, the frame is lifted, and, as a result of movement of the pins 8a out of the holes 9 in printing table 1, the surface or edge of surface 10b is raised above the registering pegs 6. When the table 1 is moved in the direction P, the material 10 will accompany the table until the edge surface 10b strikes the device 80. The device 80 exhibits a recess 81 which is intended to co-act with the edge surface 10b. The bottom portion 82 of the recess comprises an elastic material. Both the part 83 and the part 84 are made of metal and said parts are held together by means of a screw joint 85. The recess 86 is intended to be able to embrace the beam 60. The device 80 is mounted on the beam 60 by means of a screw joint, so arranged that the device 80 can be secured at any position along the beam.

Figure 9:
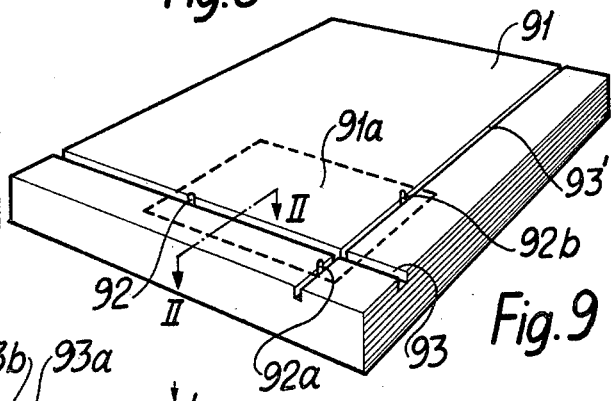
FIG. 9 is a perspective view of an embodiment of a printing table for a printing machine.

In FIG. 9 there is shown a further embodiment of a printing table 91 (this embodiment being slightly different to the printing table shown in FIG. 1) for a printing machine, preferably a silkscreen printing machine. The invention includes a registering means intended for the printing table 1 of a printing machine, three such registering means 92, 92a and 92b being shown in FIG. 9. These registering means have the form of pegs intended to engage holes in a material 91a to be printed, thereby to position the material exactly on the printing table 91 relative to the pattern on the stencil (not shown). Since the registering means 92, 92a and 92b are identical, only the registering means 92 will be described.

Figure 10:
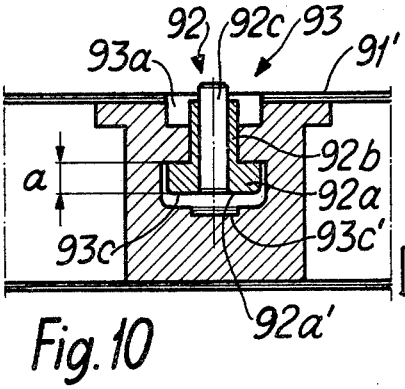
FIG. 10 is a sectional view taken through the line II—II in FIG. 9.

The registering means 92 is fixedly arranged in a groove 93 formed in the printing table. The registering means 92 is held by means of a holding device 94. The groove 93 is crossed by a further groove 93', and it will be seen from FIG. 9 that the groove 93 co-acts with the registering means 92 whilst the groove 93' co-acts with the registering means 92a and 92b. As shown in the figure, the grooves 93 and 93' can extend to the end surface of the table or may terminate some distance from the end surface in a recess which is somewhat wider than the groove. As shown in FIG. 10, the groove has an upper portion 93a, a centrally arranged constricted portion 93b (See FIG. 12) and a lower portion 93c. The shape of the groove will be described in more detail with reference to FIG. 12.

The registering means 92 has an edge 92a which is intended to be engaged in the lower portion 93c of the groove. A central part of the registering means 92b is arranged to pass through the centrally arranged constriction 93b in the groove and to extend slightly into the upper part 93a. The registering peg 92c of the registering means 92a is arranged to extend somewhat above the printing surface of the printing table. The printing surface is shown at 91'.

Figure 2:
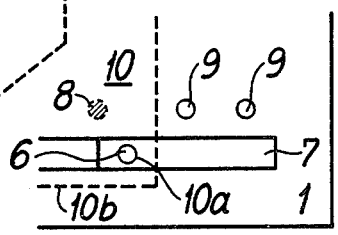
FIG. 2 is a horizontal view of a corner portion of the printing table.

The holding means 94 comprises two adjacently located screws (FIG. 11) which are intended to co-act with threaded holes disposed in the registering means. In their fixed co-action with the printing table, the screws are arranged to extend towards and to abut against the bottom 93c' of the lower part 93c and to force the edge 92a upwards. The manner in which the screws co-act with said bottom is not illustrated in FIG. 2.

The edge 92a of the registering means has a thickness "a" which corresponds directly to the height "b" of the upper part 93a. It may be an advantage, however, to make the printing surface 91' of the printing table 91 from a stainless steel sheet, as illustrated in FIG. 10, in which case the distance "b" shall be increased by a value equal to the thickness of the sheet.

As a result of the special profile which the registering means exhibits in cross section, it is possible to insert the registering means upside down in the groove, so that the bottom part of the registering means (hereinafter referred to as the profile) forms part of the planar printing surface 91' and in this way serve to close the otherwise open groove.

Figure 11:
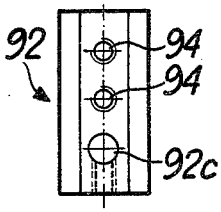
FIG. 11 is a horizontal view of a registering means having a limited longitudinal extent.

FIG. 11 illustrates a registering means of limited longitudinal extension, said registering means exhibiting a registering pin 92c and the necessary screws 94 for holding the registering means in the desired position in the groove.

Figure 13:
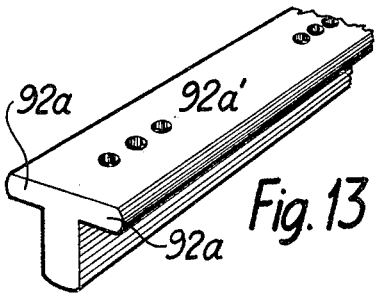
FIG. 13 is a perspective view of a profile which is inverted relative to the position shown in FIG. 11 and which has a length considerably in excess of the length of the registering means shown in FIG. 11.

FIG. 13 illustrates a registering means of much longer longitudinal extension, this registering means being shown inverted relative to the registering means shown in FIG. 11. As will clearly be seen from FIG. 13, as soon as the profile is inserted into the groove, the edge 92a will rest in the upper portion 93a and the surface 92a' will then lie in the same plane as the printing surface 91' and the groove is covered.

Figure 12:
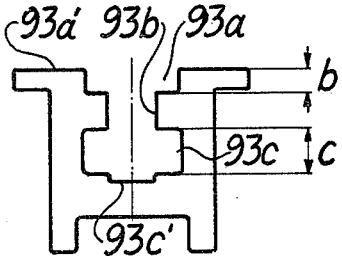
FIG. 12 is a side view of a beam arranged in the printing table, said beam having a groove which exhibits an upper part, a centrally arranged constricted part and a lower part.

FIG. 12 is a cross-sectional view of a beam so formed as to exhibit the aforementioned groove. This beam is especially designed to be able to be cast in a printing table 91 and the beam is also so designed that the correct height dimension of the upper part 93*a* is only obtained subsequent to mounting a stainless steel plate on the surface 93*a'* of the beam. The beam has an upper edge (beneath the surface 93') to enable it to be cast in the printing table. It should be mentioned that the member in which the groove is formed, with the upper part 93*a*, the centrally arranged restricted portion 93*b* and the lower part 93*c* is an extruded member. The upper part has a width corresponding directly to the width of the lower part. The width of the constricted part 93*b* corresponds approximately to half the width of the groove. The groove 93 need not cross the groove 93', as shown in FIG. 9.

The profile for the registering means 92 (FIG. 11 and FIG. 13) is also an extruded member and this means that also the actual profile, without the registering means, can be turned upside down and inserted in the groove to cover the same. In this case the profile should be cut to a suitable length.

The invention is not restricted to the illustrated embodiment, but can be modified within the scope of the accompanying claims.

I claim:

1. A printing machine of the type having a stencil and a squeegee associated therewith which is intended to press printing ink from said stencil upon a material to be printed, said printing machine comprising:

a frame;

a reciprocatingly movable printing table supported by said frame which is movable between a first position wherein said material to be printed is placed on said table and a second position wherein said material is printed upon;

registering means in said movable printing table which co-acts with corresponding registering means in the material to be printed to position said material relative to said printing table;

means to lift the leading edge of the material to be printed from the printing table during movement of said table from said second position to said first position to disengage the material from the registering means in said table;

means to discharge said material from said printing table; and stop means spaced from said table and fixedly attached to said frame and arranged to engage the leading edge of the material to be printed after said leading edge is lifted from the table, said stop means stopping the movement of said material upon engagement with said leading edge while continued movement of said printing table from said second position to said first position causes the table to move from beneath the material so as to remove the material from said printing table and causing the material to be brought into cooperative engagement with said discharge means.

2. The printing machine of claim 1 wherein roller conveying means are situated adjacent said discharge means.

3. The printing machine of claim 2 wherein said roller conveying means terminates adjacent an inclined surface.

4. The printing machine of claim 1 wherein said means to lift said leading edge of said material to be printed comprises at least one pin disposed within at least one hole within said printing table, said at least one pin being capable of movement from a position in which said at least one pin does not extend above the surface of said printing table to a position wherein said at least one pin extends above the surface of said printing table.

5. The printing machine of claim 4 wherein said at least one hole comprises a plurality of holes arranged adjacent said registering means.

6. The printing machine of claim 4 wherein said at least one pin comprises a plurality of pins which cooperate with a beam member capable of movement in a vertical direction in order to raise and lower said plurality of pins.

7. The printing machine of claim 1 wherein said discharge means comprises rod-like members arranged parallel to the direction of movement of said printing table.

8. The printing machine of claim 1 wherein said stop means comprises at least one member mounted on a beam which is fixedly mounted laterally across said printing table to said frame.

9. The printing machine of claim 8 wherein said at least one member has a recess for engaging said leading edge of the material to be printed.

10. The printing machine of claim 8 wherein the lower portion of said recess comprises an elastic material.

11. The printing machine of claim 1 wherein said registering means is disposed within at least one groove in a surface of said printing table.

12. The printing machine of claim 11 wherein said registering means comprises at least one peg-like member which extends above said surface of the printing table.

* * * * *